US010065330B1

(12) United States Patent
Weisman

(10) Patent No.: US 10,065,330 B1
(45) Date of Patent: Sep. 4, 2018

(54) UTILITY SCISSORS ASSEMBLY

(71) Applicant: Gregory Lawrence Weisman, Palm Beach, FL (US)

(72) Inventor: Gregory Lawrence Weisman, Palm Beach, FL (US)

( * ) Notice: Subject to any disclaimer, the term of this patent is extended or adjusted under 35 U.S.C. 154(b) by 0 days.

(21) Appl. No.: 15/447,384

(22) Filed: Mar. 2, 2017

(51) Int. Cl.
*B26B 13/22* (2006.01)
*B26F 1/32* (2006.01)

(52) U.S. Cl.
CPC ..... *B26B 13/22* (2013.01); *B26F 1/32* (2013.01)

(58) Field of Classification Search
CPC ..... B26B 13/00; B26B 13/22; B26B 13/12; B26F 1/32; B26F 1/36; B26F 2001/365
USPC ..... 30/194, 244, 250, 252, 254
See application file for complete search history.

(56) References Cited

U.S. PATENT DOCUMENTS

| | | | | |
|---|---|---|---|---|
| 464,075 | A | 12/1891 | Krank | |
| 812,645 | A | 2/1906 | Gardner | |
| 1,356,119 | A * | 10/1920 | Bassisty | B26B 13/22 30/226 |
| 9,108,313 | B2 | 8/2015 | Gonzalez | |
| 2001/0005913 | A1 | 7/2001 | Elsener et al. | |
| 2005/0150333 | A1 | 7/2005 | Rivera et al. | |
| 2008/0086895 | A1 | 4/2008 | Parks | |
| 2010/0107426 | A1 | 5/2010 | Cedar | |

FOREIGN PATENT DOCUMENTS

| | | |
|---|---|---|
| CN | 101456187 | 6/2009 |
| GB | 134808 | 11/1919 |
| JP | 61172799 | 10/1986 |
| JP | 6227568 | 2/1987 |

OTHER PUBLICATIONS

Amazon.com, Inc., "Westcott Preschool Training Scissors, Assorted Colors" [online] (retrieved from the internet on Apr. 25, 2018) <URL https://www.amazon.com/Westcott-Preschool-Training-Scissors-Assorted/dp/B00CL55HS2>, Sep. 27, 2014; Entire document, especially p. 1 and Figs. 1-2, 5 pages.
Search Report and Written Opinion dated May 29, 2018 for PCT Application No. PCT/US18/20492, 10 pages.

* cited by examiner

*Primary Examiner* — Phong Nguyen
(74) *Attorney, Agent, or Firm* — Patterson Thuente Pedersen, P.A.

(57) ABSTRACT

A utility scissors assembly structured to facilitate the cutting and/or punching a hole in a material item, through the provision of a combination scissors device and a retractable punch mechanism. A utility scissors assembly includes two pivotally connected utility members pivotable between a open and a closed position, each including a blade portion and a handle portion. The punch mechanism may be connected to a utility member and pivotable thereon into and out of an exposed, operative orientation corresponding to the utility member. The second utility member may include an aperture disposed and structured to engage and receive the correspondingly aligned punch mechanism, at least when the punch mechanism is in the operative orientation and the utility members are in the closed position.

18 Claims, 3 Drawing Sheets

UTILITY SCISSORS ASSEMBLY

BACKGROUND OF THE INVENTION

Field of the Invention

The present invention is directed to a pivotable and retractable punch mechanism mounted on and operable in combination with a utility scissors assembly, wherein the punch mechanism is retractably secured to and movable with the utility scissors assembly. More specifically, the punch mechanism is retractable within the utility scissors assembly into and out of an exposed, operative orientation. Further, the exposed punch mechanism is movable with handle assemblies of the utility scissors assembly into and out of a closed position.

DESCRIPTION OF THE RELATED ART

Numerous individuals seek a safe and convenient way to perform everyday tasks such as wrapping gifts, crafting home projects, sewing, etc. When performing such tasks, individuals inevitably will need to make a hole in the material being used.

Known cutting or hole punching devices which are readily available on the commercial market include an individual pair of scissors or an individual hole punch.

Most households have at least one pair of ordinary scissors. In fact, common utility scissors are one of the most widespread household utensils found anywhere, and for good reason—they are great at doing what they are designed for, which is cutting paper, cloth, and other such materials. However, when it comes to punching holes, a pair of ordinary scissors is decidedly not a great tool—it leaves holes that are not round and are thus significantly more prone to tearing.

But, since a hole punch is more limited in its functionality, and does not perform as a scissor, fewer households have them, and therefore they never seem to be around when the need for their superior performance arises.

While numerous individuals require a device that facilitates both cutting and hole punching, care and awareness are also needed in order to avoid injury from a fixed extended hole punch.

Accordingly, there is a need for a device that features a pivotable and retractable hole punch mechanism. There appears to be an absence of a combined structure having multi-purpose uses such that a scissors device may be safely utilized with an punch mechanism, such as a hole punch. Despite development and advancement in the art, there is still a need for an improved scissors device which can be combined with a punch mechanism that provides a safe way to use both functions.

SUMMARY OF THE INVENTION

The present invention is directed to a utility scissors assembly, including a retractable punch mechanism, for cutting and/or punching a hole in a material item. In more specific terms, the punch mechanism may be pivotably connected to and used in combination with a scissors function of the assembly.

Accordingly, a detailed description of the structural and operative features of the present invention will be set forth in greater detail hereinafter with reference to a utility scissors assembly including a retractable punch mechanism. However, it is emphasized that the punch mechanism of the present invention can be mounted on and operable in combination with the scissors function of the assembly.

Therefore, one or more preferred embodiments of the present invention includes the referred to utility scissors assembly, which may include a first utility member and a second utility member pivotally interconnected and positionable between an open position and a closed position. The first and second utility members may each include a blade portion and a handle assembly portion.

Additionally, the blade portion of the first and second utility members are structured and disposed to cut a material item, at least when the first and second utility members are in the closed position. The handle assembly portion of the first utility member may comprise a recess portion and a punch mechanism. The punch mechanism may be pivotally connected within the recess portion and positionable therein between an operative orientation and a non-operative orientation.

Further, the handle assembly portion of the second utility member may comprise an aperture dimensioned and configured to at least partially receive the punch mechanism therein, at least when the first and second utility members are in the closed position and the punch mechanism is in the operative orientation.

In addition, the punch mechanism may be structured and disposed to create a hole in a material item, at least when the first and second utility members are in the closed position and the punch mechanism is in the operative orientation. The operative and non-operative orientations respectively may comprise an exposed and a stowed disposition of the punch mechanism.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
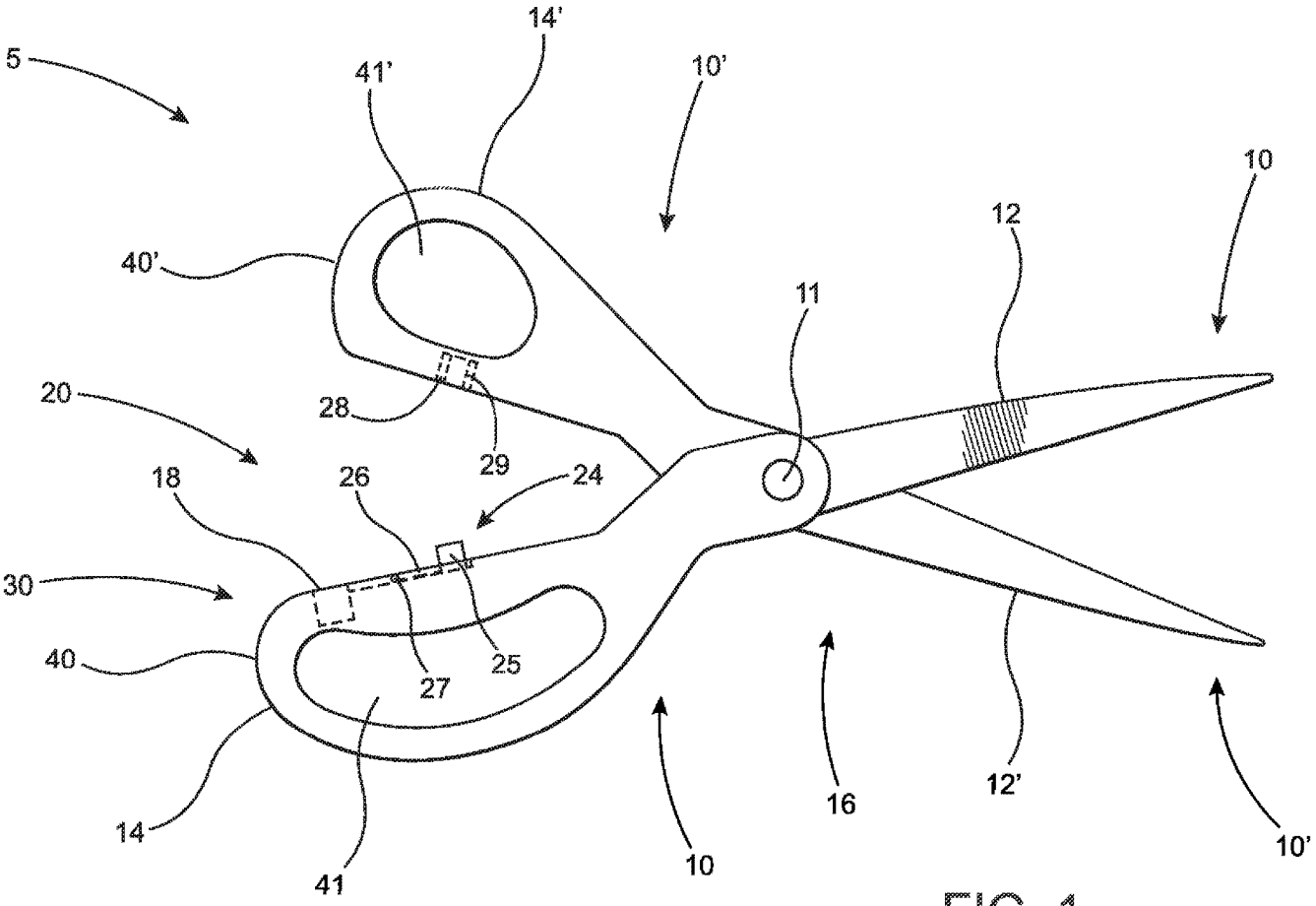
FIG. 1 is a side view of a utility scissors assembly in an open position including a punch mechanism depicted in an exposed, operative orientation.

As shown in the accompanying drawings, the present invention is directed to a utility scissors assembly generally indicated as 5. The utility scissors assembly 5 includes first and second utility members 10, 10' pivotally interconnected at member pivot 11 and positionable between an open position 16 and a closed position 16', as discussed in more detail below. The utility scissors assembly 5 includes sufficient structural and operative versatility to facilitate its use as a cutting device structured and disposed to cut a material item. Accordingly, each of the first and second utility members 10, 10' comprise a blade portion 12, 12' and an interconnected corresponding handle assembly portion 14, 14'. Each blade portion 12, 12' is attached to corresponding ends of the handle assembly portions 14 14', such that each blade portion 12, 12' and corresponding interconnected handle assembly portion 14, 14' may collectively form an integrated construction. When so integrated, inadvertent disconnection of a blade portion from a corresponding handle assembly portion is prevented. The integrated construction of the blade portion 12, 12' and corresponding ones of the handle assembly portion 14, 14' may be facilitated by an adhesive or other connection technique.

Each of the blade portions 12, 12' is formed of a substantially rigid material, as well as that of each handle assembly portion 14, 14', remaining substantially constant, at least in terms of not being deformed, when a resistance such as a pushing or pulling force, weight, etc. is exerted thereon. The substantially constant rigidity of the blade portions 12, 12' is further maintained by being formed from a metallic or other substantially rigid material. The substantially constant rigidity of the handle assembly portions 14, 14' is further maintained by the forming from a hard plastic or other substantially rigid material. The specific dimensions of the blade portions 12, 12' and the corresponding interconnected handle assembly portions 14, 14' may vary. For example, the two handle assembly portions 14, 14' may differ in width. More specifically, the handle assembly portion 14 of the first utility member 10 may have a substantially greater width or transverse dimension than the handle assembly portion 14' of the second utility member 10', as discussed in more detail below.

Figure 1A:
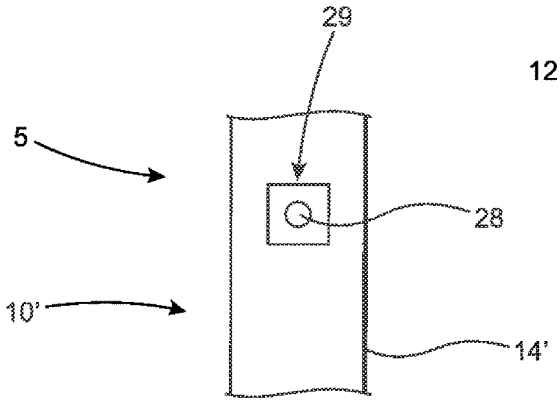
FIG. 1A is a bottom view of an aperture including structural and operative components of the embodiment in FIG. 1.
Figure 1B:
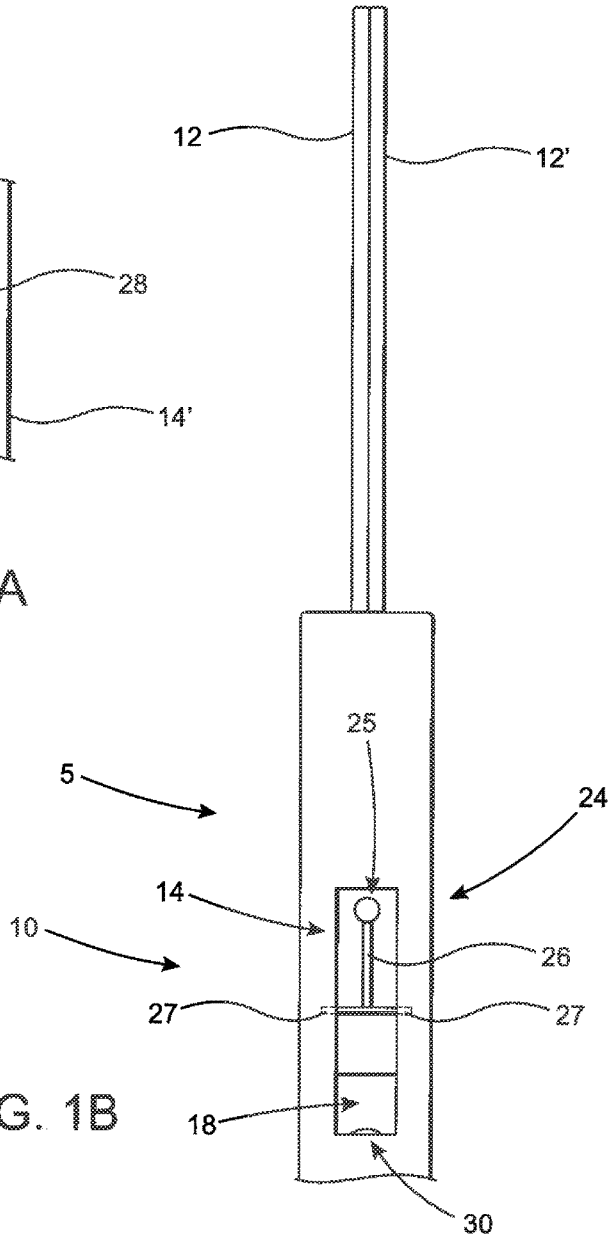
FIG. 1B is a top view of a punch mechanism and recess portion including structural and operative components of the embodiment in FIG. 1.

As represented in FIGS. 1 and 1B, one or more preferred embodiments of the present invention include the utility scissors assembly 5 comprising a punch mechanism 24 connected to one of the utility members 10, 10' and structured and disposed to punch a hole in a material item. The punch mechanism 24 includes sufficient structural and operative versatility to facilitate its use while mounted on the utility scissors assembly 5 and used in combination with the blade portions 12, 12'. The punch mechanism 24 is preferably disposed, dimensioned and configured in the form of a hole punch.

Figure 2:
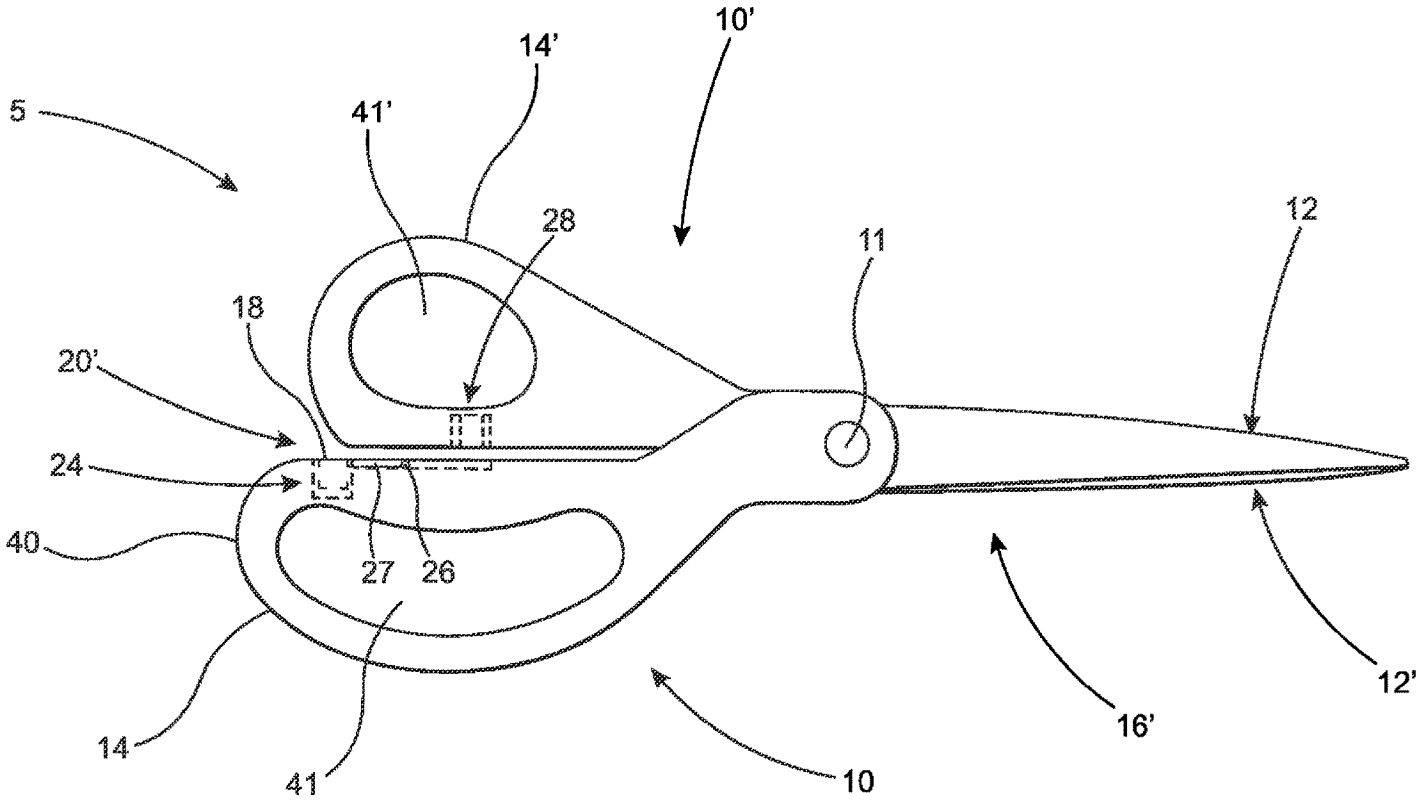
FIG. 2 is a side view of a utility scissors assembly in a closed position including a punch mechanism depicted in a stowed, non-operative orientation.

In the preferred embodiment, the punch mechanism 24 may be pivotally or retractably connected to the handle assembly 14 of the first utility member 10 at punch pivot 27. As such, the punch mechanism 24 may be selectively disposable between an operative orientation 20 and a non-operative orientation 20'. The retractability of the punch mechanism 24 enhances the safety of the user. For example, when the punch mechanism 24 is disposed in the operative orientation 20, the user can utilize the utility scissors assembly 5 as a hole punch, as represented in FIG. 1. However, when the punch mechanism 24 is not needed for use, the punch mechanism 24 can be easily and quickly pivoted to the stowed non-operative orientation 20', as represented in FIG. 2. This will allow the user to utilize the utility scissors assembly 5 as a pair of scissors without worrying about injury from the punch mechanism 24. As such, there will be no chance of damage to the user's digit or hand by a rigid metal hole punch.

Further, and represented in FIG. 1, the punch mechanism 24 may include a target portion 25 structured and disposed to engage a material item and an arm portion 26 disposed in interconnecting relation between the target portion 25 and the first utility member 10. The first utility member 10 may further comprise a recess or cavity portion 18 such that the punch mechanism 24 may be pivotally connected to the utility member 10 and pivotal into and out of the recess portion 18 and positionable relative there to between the operative and non-operative orientations 20,20'. More specifically, the target portion 25 of the punch mechanism 24 may be at least partially within the recess portion 18 of the first utility member 10, when the punch mechanism 24 is in the stowed non-operative 20' orientation. As such, when the punch mechanism 24 is in the non-operative orientation 20', the punch mechanism 24 may not be exposed and not clearly viewable, as represented in FIG. 2.

In contrast, when the punch mechanism 24 is in the operative orientation 20, the target portion 25 may be exposed and clearly viewable, at least when the first and second utility members 10, 10' are in the open position 16, as represented in FIG. 1. Further, when the punch mechanism 24 is in the operative orientation 20 and the first and second utility members 10, 10' are in the open position 16, at least a portion of the recess portion 18 may be exposed and viewable, as represented in FIG. 1B. In contrast, when the punch mechanism 24 is in the non-operative orientation 20' the recess portion 18 may not be exposed and not clearly viewable, as represented in FIG. 2. However, when the first and second utility members 10, 10' are in the closed position 16', the punch mechanism 24 and the recess portion 18 may not be clearly viewable, even when the punch mechanism is in the operative orientation 20, as discussed below.

As such, the punch mechanism 24 is operatively positioned so as to pivot into and out of the operative orientation 20 when the first and second utility members 10, 10' are not in the closed position 16', as represented in FIG. 1. The punch mechanism 24 is operatively positioned between an outwardly exposed extending orientation relative the first utility member 10 and a stowed aligned and/or substantially parallel orientation relative the first utility member 10. More specifically, the punch mechanism 24 is in the operative orientation 20 when the punch mechanism 24 is operatively positioned in an outwardly extending transverse orientation relative the first utility member 10. In contrast, the punch mechanism 24 is in the non-operative orientation 20' when the punch mechanism 24 is positioned in an aligned and/or substantially parallel orientation relative the first utility member 10.

As mentioned above, when disposed in the non-operative orientation 20', the target portion 25 of the punch mechanism 24 is disposed at least partially within the recess portion 18 in a parallel relation relative to the first utility member 10. However, when the punch mechanism 24 is intended for use, the punch mechanism 24 may be pivoted to the operative orientation 20. As mentioned above, when in the operative orientation 20, the target portion 25 of the punch mechanism 24 is disposed in an outwardly extending relation relative to the first utility member 10.

In addition, the first utility member 10 may further comprise the aforementioned latch mechanism 30 structured to position the punch mechanism 24 in the non-operative orientation 20'. However, when the punch mechanism 24 is needed for use, it may be pivoted to the operative orientation 20, at least when the first and second utility members are in the open position 16. Further, the arm portion 26 of the punch mechanism 24 is calibrated or otherwise structured to hold the position of the punch mechanism 24 in the outwardly extending operative orientation 20. However, when the punch mechanism 24 is no longer needed for use, it may be pivoted back and held in the non-operative orientation 20' by the latch mechanism 30.

Another preferred embodiment of the present invention includes the second utility member 10' having at least one aperture 28 cooperatively dimensioned and configured to at least partially receive the punch mechanism 24 therein, at least when the first and second utility members 10, 10' are in the closed position 16' and the punch mechanism 24 is in the operative orientation 20. As illustrated in FIGS. 1A and 2, the aperture 28 is disposed in the handle assembly 14' of the second utility member 10' substantially adjacent the corresponding operatively oriented 20 punch mechanism 24 of the first utility member 10. As such, the punch mechanism 24 is disposed in secured aligning relation with the aperture 28 at least when the punch mechanism 24 is in the operative orientation 20.

Accordingly, when the punch mechanism 24 is in the operative orientation 20 and the first and second utility members 10, 10' are in the closed position 16', the target portion 25 may be disposed inside of the aperture 28 and not clearly viewable. In contrast, when the punch mechanism 24 is in the operative orientation 20 and the first and second utility members 10, 10' are in the open position 16, the punch mechanism 24 may be exposed, accessible and clearly viewable, as represented in FIG. 1.

Further, when the punch mechanism 24 is in the operative orientation 20 and the first and second utility members 10, 10' are in the open position 16, at least some of the recess portion 18 may be exposed and viewable, as represented in FIG. 1B. In contrast, when the punch mechanism 24 is in the operative orientation 20 and the first and second utility members 10, 10' are in the closed position 16', the recess portion 18 may not be clearly viewable.

As mentioned above, the utility scissors assembly 5 includes sufficient structural and operative versatility to facilitate its use as a pair of scissors structured and disposed to cut a material item. However, when the punch mechanism 24 is intended for use and the first and second utility members 10, 10' are not in the closed position 16', the punch mechanism 24 may be pivoted from the non-operative orientation 20' to the operative orientation 20. As such, the operative versatility of the utility scissors assembly 5 may concurrently facilitate its use as a pair of scissors and/or a hole punch, as represented in FIG. 1.

In addition, at least a portion of the punch mechanism 24 is preferably formed from at least a partially rigid material to the extent that a punching force, sufficient to punch a hole in a material item, will be exerted therefrom. By way of example, the punch mechanism 24, or at least a portion thereof, may be formed from a metal which has sufficient rigidity and strength to exert the aforementioned punching force to punch a hole. Further, the aperture 28 may include a ring 29 formed from at least a partially rigid material, structured to cut a material item when the material item and the punch mechanism 24 are at least partially received therein. The force exerted on the underside of a material item from the punch mechanism 24 concurrently with the cutting force of the ring 29 on the topside may create the necessary force to punch a hole therein.

As discussed above, the at least partially rigid ring 29 is disposed to receive the punching force from the metal punch mechanism 24, which will be exerted thereon when the user attempts to punch a hole in a material item. As such, the ring 29, or at least a portion thereof, may also be formed from a metal which has sufficient rigidity and strength to receive the aforementioned punching force from the punch mechanism 24.

As illustrated in FIGS. 1 and 2, the handle assembly portions 14, 14' may include a grip 40, 40' of sufficient dimension, configuration and strength to facilitate the gripping of each handle assembly portion 14, 14' with a single hand of the user. Therefore, when the utility scissors assembly 5 is in use, as a scissors and/or a hole punch, a hand of the user may be disposed in gripping engagement with the grips 40, 40'. More specifically, each grip 40, 40' may comprise at least one digit or finger loop 41, 41' of sufficient dimension, configuration and strength to facilitate the gripping of each handle assembly portion 14, 14' with a digit(s) of the user. Therefore, when the utility scissors assembly 5 is in use, as a scissors and/or a hole punch, at least one digit of a user may be disposed in gripping engagement with each finger loop 41, 41'. Further, the aperture 28, the recess portion 18, and/or the punch pivot 27 may not be visible to the user in a side view of the utility scissors assembly 5 in the open position 16, but are depicted in FIG. 1 for illustrative purposes. Similarly, the aperture 28, the recess portion 18, the punch mechanism 24, and/or the punch pivot 27 may not be visible to the user in a side view of the utility scissors assembly 5 in the closed position 16', but are depicted in FIG. 2 for illustrative purposes.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A utility assembly comprising:

a first utility member and a second utility member pivotally interconnected and positionable between an open position and a closed position; said first and second utility members each including a blade portion and a handle assembly portion defining a distal end and a proximal end respectively thereof, said blade portions of said first and second utility members structured and disposed to cut a material item, at least when said first and second utility members are in said closed position, said handle assembly portion of said first utility member comprising a punch mechanism pivotally connected to said handle assembly portion of said first utility member and positionable thereon between an operative orientation and a non-operative orientation, said handle assembly portion of said second utility member comprising an aperture dimensioned to at least partially receive said punch mechanism therein, at least when said first and second utility members are in said closed position and said punch mechanism is in said operative orientation, said punch mechanism structured and disposed to punch a hole in a material item, at least when said first and second utility members are in said closed position and said punch mechanism is in said operative orientation, and said operative and non-operative orientations respectively comprising an exposed and a stowed disposition of said punch mechanism.

2. The utility assembly as recited in claim 1 wherein said handle assembly portion of said first utility member further comprises a recess portion; said punch mechanism pivotally connected at least partially within said recess portion and positionable thereon between said operative orientation and said non-operative orientation.

3. The utility assembly as recited in claim 2 wherein said punch mechanism further comprises a target portion disposed and structured to engage a material item and an arm portion disposed in interconnecting relation between said target portion and said recess portion.

4. The utility assembly as recited in claim 1 wherein said punch mechanism further comprises a target portion disposed and structured to engage a material item and an arm portion disposed in interconnecting relation between said target portion and said handle assembly portion of said first utility member.

5. The utility assembly as recited in claim 1 further comprising a latch mechanism structured to position said punch mechanism in said non-operative orientation.

6. The utility assembly as recited in claim 1 wherein said handle assembly portion of said first and second utility members further comprises a grip portion disposed and structured to removably support a hand of a user.

7. The utility assembly as recited in claim 1 wherein said punch mechanism is formed of an at least partially rigid material.

8. The utility assembly as recited in claim 7 wherein said punch mechanism is at least partially formed of metal.

9. The utility assembly as recited in claim 1 wherein said aperture comprises at least one ring formed of an at least partially rigid material.

10. The utility assembly as recited in claim 9 wherein said ring is at least partially formed of metal.

11. The utility assembly as recited in claim 9 wherein said ring is structured and disposed to cut a material item, at least when said punch mechanism and the material item are at least partially received therein.

12. A utility assembly comprising:

a first utility member and a second utility member pivotally interconnected and positionable between an open position and a closed position; said first and second utility members each including a blade portion and a handle assembly portion defining a distal end and a proximal end respectively thereof, said blade portions of said first and second utility members structured and disposed to cut a material item, at least when said first and second utility members are in said closed position, said handle assembly portion of said first utility member comprising a recess portion and a punch mechanism; said punch mechanism pivotally connected to said first utility member and pivotal into and out of said recess portion and positionable relative thereto between an operative orientation and a non-operative orientation, said handle assembly portion of said second utility member comprising an aperture dimensioned to at least partially receive said punch mechanism therein, at least when said first and second utility members are in said closed position and said punch mechanism is in said operative orientation, said punch mechanism structured and disposed to punch a hole in a material item, at least when said first and second utility members are in said closed position and said punch mechanism is in said operative orientation, and said operative and non-operative orientations respectively comprising an exposed and a stowed disposition of said punch mechanism.

13. The utility assembly as recited in claim 12 further comprising a latch mechanism structured to position said punch mechanism in said non-operative orientation.

14. The utility assembly as recited in claim 12 wherein said punch mechanism further comprises a target portion disposed and structured to engage a material item and an arm portion disposed in interconnecting relation between said target portion and said recess portion of said first utility member.

15. The utility assembly as recited in claim 14 wherein said aperture is dimensioned to at least partially receive said target portion of said punch mechanism therein, at least when said first and second utility members are in said closed position and said punch mechanism is in said operative orientation.

16. The utility assembly as recited in claim 12 wherein said handle assembly portions of said first and second utility members each further comprise a grip portion disposed and structured to removably support a hand of a user.

17. The utility assembly as recited in claim 16 wherein said grip portions of said first and second utility members each further comprise a digit portion disposed and structured to removably support a digit of a user.

18. The utility assembly as recited in claim 17 wherein each of said digit portions of said first and second utility members comprise at least one finger loop.

* * * * *